United States Patent [19]

Rock

[11] 3,951,406

[45] Apr. 20, 1976

[54] PORTABLE PLATFORM TENNIS COURT

[75] Inventor: James H. Rock, Sewickley, Pa.

[73] Assignee: American Platform Tennis Systems, Butler, Pa.

[22] Filed: Sept. 24, 1973

[21] Appl. No.: 401,802

Related U.S. Application Data

[63] Continuation-in-part of Ser. No. 275,283, July 26, 1972, abandoned.

[52] U.S. Cl. ..... 273/29 R; 272/3; 52/222

[51] Int. Cl.[2] ..... A63B 61/00

[58] Field of Search..... 272/3; 273/29 R, 26 A; 52/222, 273, 750, 484; 160/372, 375, 378, 380, 398

[56] References Cited

UNITED STATES PATENTS

| | | | |
|---|---|---|---|
| 1,123,136 | 12/1914 | Northrop | 160/327 |
| 1,267,197 | 5/1918 | Euler | 160/328 |
| 2,205,398 | 6/1940 | Eaton | 273/29 R X |
| 2,823,034 | 2/1958 | Bingham, Jr. | 273/26 A X |
| 3,283,804 | 11/1966 | Yancy | 160/328 X |
| 3,745,729 | 7/1971 | Vaughn | 52/222 |

*Primary Examiner*—Richard C. Pinkham
*Assistant Examiner*—T. Brown
*Attorney, Agent, or Firm*—Webb, Burden, Robinson & Webb

[57] ABSTRACT

The paddle tennis court includes a steel, rectangular underframe having spaced cross members, steel uprights connected to the underframe and a deck preferably comprised of a plurality of independent units. Each independent unit has a plurality of metal or wooden boards secured in place by steel angles. The steel angles connect to the underframe. Adjustable steel piers can be secured to the rectangular underframe to permit leveling of the court. An in-line tensioning device operable between the steel angle and the underframe, independent of the wooden deck, provides a high tension framed screen end and side walls. The screen is secured to the court through a plurality of hook members which grip the screen and the screen framing.

1 Claim, 15 Drawing Figures

PORTABLE PLATFORM TENNIS COURT

BACKGROUND OF THE INVENTION

This application is a continuation-in-part of my earlier filed, copending application, filed July 26, 1972, bearing Ser. No. 275,283, and since abandoned.

My invention relates to paddle tennis courts and, more particularly, to portable and prefabricated paddle tennis courts having unitized decks, adjustable steep piers, an in-line tensioning device for the screened side and end walls and hook members to secure the screen to the frame which supports it.

Platform tennis, commonly referred to as paddle tennis, is played on a raised platform having screened side walls and end walls. Heretofore, such courts have routinely been made of all wood and more recently of rigid aluminum construction. The playing surface or deck is a critical component of the paddle tennis court. A deck must provide a flat surface and, at the same time, permit easy maintenance and repair. Short spans of wooden boards permit a certain ease of maintenance and repair but fail to provide the requisite flatness, especially after the passage of time. Long, specially treated boards provide the requisite flatness, but are difficult to maintain and repair. Aluminum decks, on the other hand, provide a noisy playing surface which detracts from the enjoyment of the game.

Since the game of paddle tennis is played utilizing the screened end walls and occasionally the side walls as part of the playing surface, it is necessary to maintain the screens in high tension to provide the proper bounce to a ball hit thereagainst. Heretofore, the various tensioning devices have been offset from the vertical plane of the screen and, therefore, tensioning has resulted in a torsion type action at the bottom of the wire where it is connected. In addition, these tensioning devices have been secured to the floor or deck or their supports, thereby adding unnecessary strain to the deck at least around the perimeter thereof. The court corners have been specially vulnerable to poor tensioning because of the common connections employed between the adjacent panels. Further, a large number of wall panel sections have been employed in an attempt to minimize the tensioning problem, and the fasteners employed to secure the screen to the frame are vulnerable to failure after a given period of time.

SUMMARY OF THE INVENTION

My invention provides the rigidity of an all metal court, along with the stability of a wooden deck. My court is easily installed and is adjustable for different terrains. All connections are steel to steel bolted connections. The wooden deck can be repaired in individual units and these units are connected so as to provide an over all flat, unitized deck having the characteristics of a single unit. The deck can also be made of metal board members. An in-line tensioning device results in high tension screens adjustable through steel to steel contact. The independent tensioning of adjacent wall panels in the court corners further improves the tensioning. The independent hook sections greatly increase the tensioning capability and the holding power of the screen to the screen frame. Because of the improved tensioning devices, the number of upright structural members and thus the number of wall panels is decreased and the outriggers eliminated giving the court a cleaner appearance and a greater ease of manufacture and assembly.

My paddle tennis court has a rigid, all steel frame and a unitized deck. The screen mesh forming the end and side walls is connected to the frame through a series of hook members and is adjustable through an in-line tensioning device operable independent of the deck. Adjustable steel piers are positioned at the corners and intermittent thereof around the perimeter of the court or the court can be installed on a concrete platform.

DESCRIPTION OF THE PREFERRED EMBODIMENT

Figure 1:
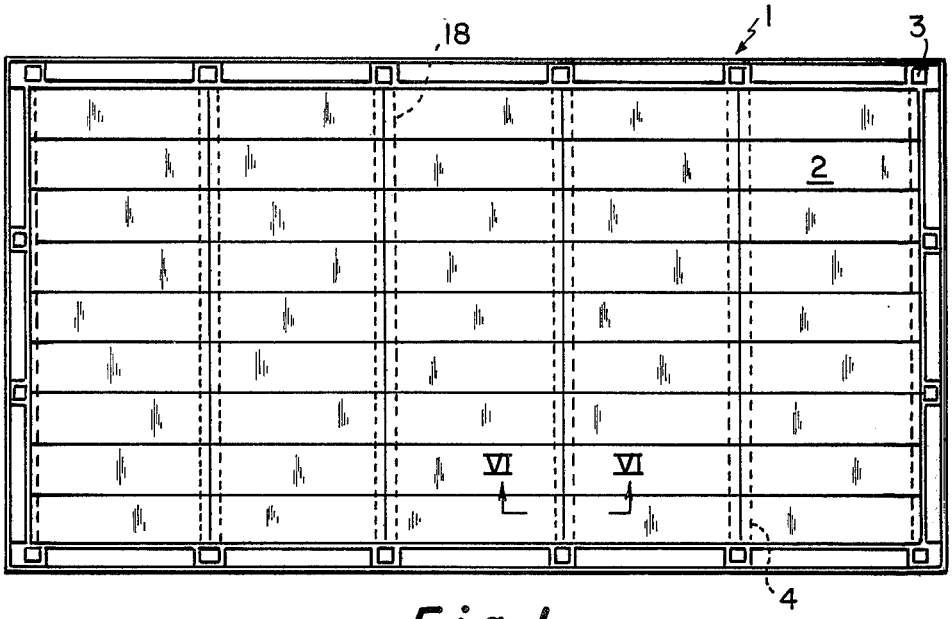
FIG. 1 is a plan view of the paddle tennis court.

The paddle tennis court, generally designated 1, includes a unitized, wooden deck 2 secured to a rigid steel underframe 4. Square steel tubing forms the uprights 3 which also connect to the underframe 4. The end and side walls are formed by framed wire screen 5 connected between and to the top of the uprights 3. Standard snow gates 6 are pivotally mounted to the uprights 3 just above the wooden deck 2. The underframe 4 is mounted on adjustable piers 7, FIGS. 1 and 2.

Figure 3:
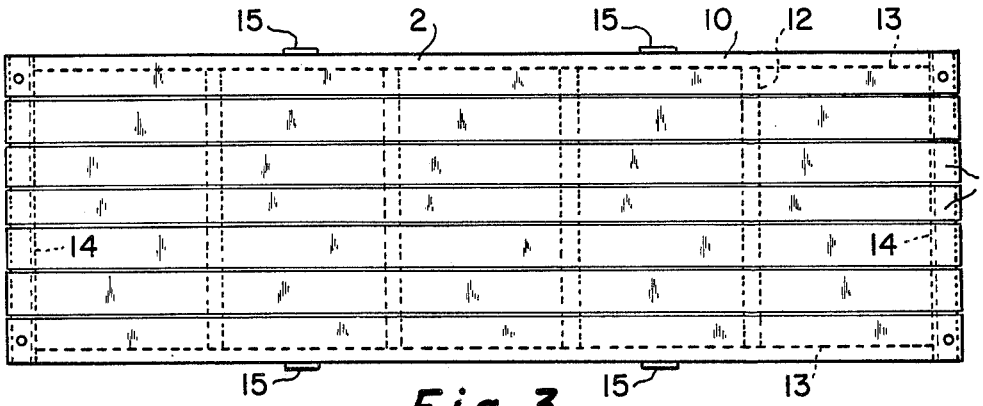
FIG. 3 is a plan view of a deck unit.
Figure 4:
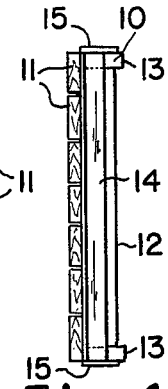
FIG. 4 is an end view of a deck unit.
Figure 5:
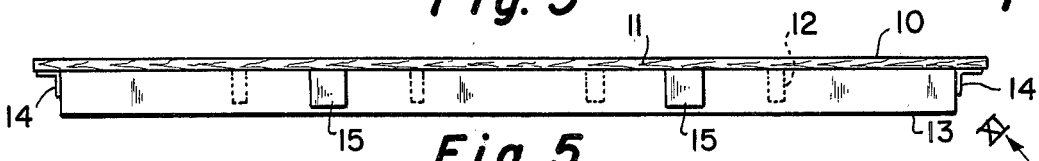
FIG. 5 is a front view of a deck unit.

The wooden deck 2 is made up of a plurality of individual units 10, FIGS. 3–5. Each unit 10 includes a plurality of boards 11 slightly spaced and in parallel relationship. The floor boards 11 are maintained in proper spaced relationship by wooden cross members 12 and wooden side members 13 which extend the length of each unit 10. Steel angles 14 are bolted to the underside of both ends of the floor boards 11. Steel side plates 15 are secured to and spaced along the wooden side members 13 so as to assure the proper spacing between adjacent units 10, when assembled to form the unitized wooden deck 2. While the unitized deck is illustrated as wood, it can also be constructed of metal members such as aluminum or steel.

The steel underframe 4 comprises steel channels 19 around the perimeter and steel wide flange beam cross members 18 secured to the channels 19, FIGS. 6–9. Each individual unit 10 is bolted to adjacent steel cross member 18. The bolted connection is a steel to steel connection in that the steel angle 14 of the unit 10 rests on a flange of the wide flange beam 18 and is bolted thereto by bolts 20, FIG. 6. A second unit is secured to the opposite, coplanar flange of the wide flange beam 18 in end to end relationship so as to provide the proper spacing between each unit 10, FIG. 6. The spacing is positioned in line with the web of the wide flange beam 18. All the units 10 are thusly connected to the underframe 4 so as to provide the unitized wooden deck 2. Each unit 10 is independent of the other units so that it can be easily removed and repaired. However, since all the units are connected to a common underframe, the deck, as a whole, acts as a single diaphragm rather than a series of independent units.

Figure 6:
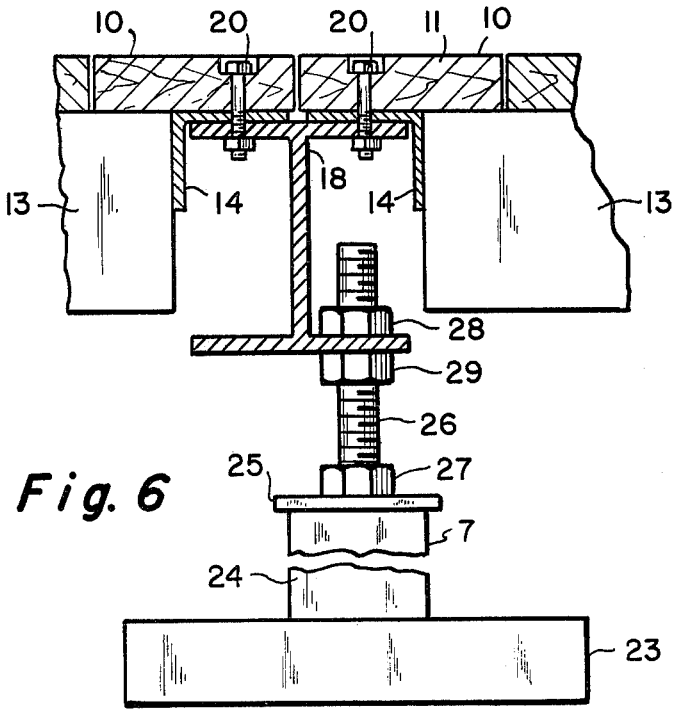
FIG. 6 is a section taken along section lines VI—VI of FIG. 1.
Figure 7:
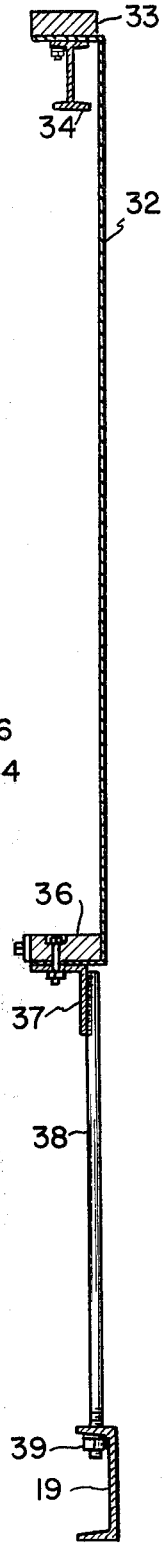
FIG. 7 is a section showing just the in-line tensioning device.
Figure 9:
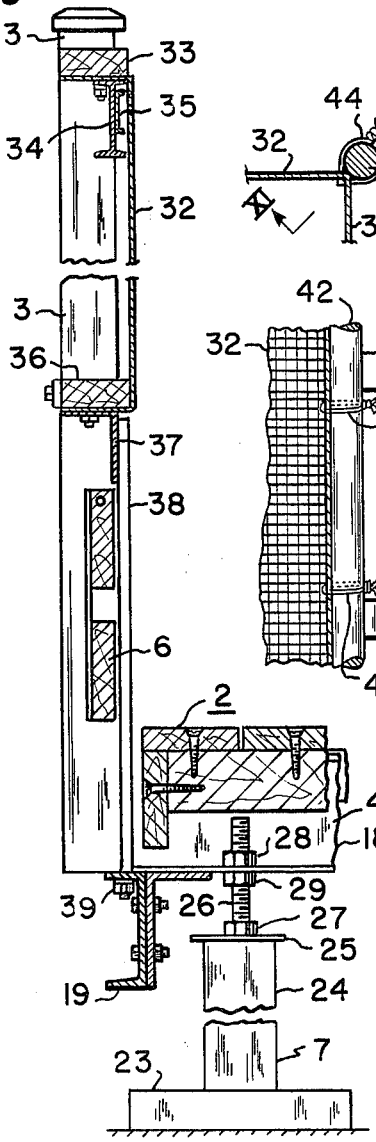
FIG. 9 is a section taken adjacent an upright.

The underframe 4 is supported by adjustable piers 7, FIGS. 6 and 9. Each pier 7 includes a thick steel base plate 23 to which is welded a square steel tube 24. A concrete foundation may be employed instead of the base plate. The steel tube 24 has a top plate 25 which is centrally apertured to accommodate threaded steel shaft 26. Nut 27 secures steel shaft 26 in place within the adjustable pier 7. Threaded steel shaft 26 extends through openings in the bottom flange of wide flange beam 18 and is held in place thereto by means of nuts 28 and 29, respectively, threaded on steel shaft 26 on either side of the bottom flange. By adjusting the various nuts along the threaded shaft 26, the underframe is raised or lowered to the desired height. An adjustable pier 7 is located at each corner of the paddle tennis court 1 and intermittent the ends of the court about the perimeter thereof and adjacent each upright 3, FIGS. 1–2.

Figure 2:
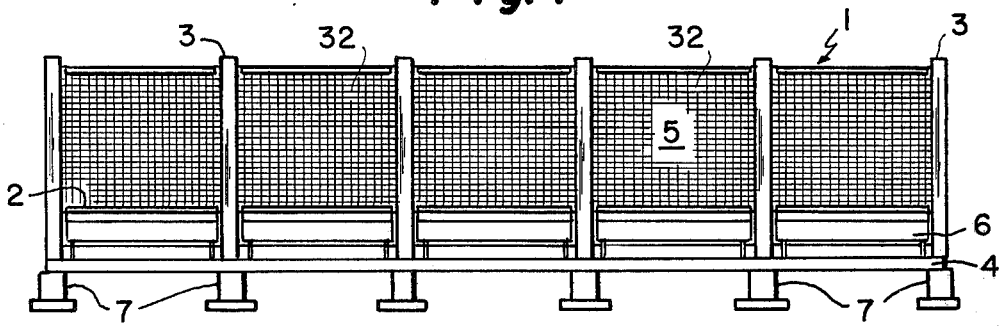
FIG. 2 is a front view of the paddle tennis court.

Between each upright 3 is mounted a side wall or end wall, as the case may be, of framed screen 5, FIG. 1. The screen itself 32 is stapled at its upper end to a frame board member 33 and a steel beam 34 is then bolted to the bottom of frame board member 33 with the screen 32 being therebetween. Steel beam 34 is, in turn, rigidly secured to a steel mounting member such as channel 35, which is welded to the upright 3 and which connects adjacent framed screen panels 5, FIGS. 8 and 9. Frame board member 33 is similarly connected at both ends so that the upper end of screen 32 is rigidly mounted between adjacent uprights 3. The beam 34, which is welded to the upright 3 and channel 35, prevents the uprights from tilting in or out, thereby eliminating the need for outriggers as employed heretofore. The lower end of screen 32 is freely suspended and secured to a bottom frame board member 36 which, in turn, is bolted to steel angle 37, the screen being positioned therebetween, FIG. 7.

Figure 12:
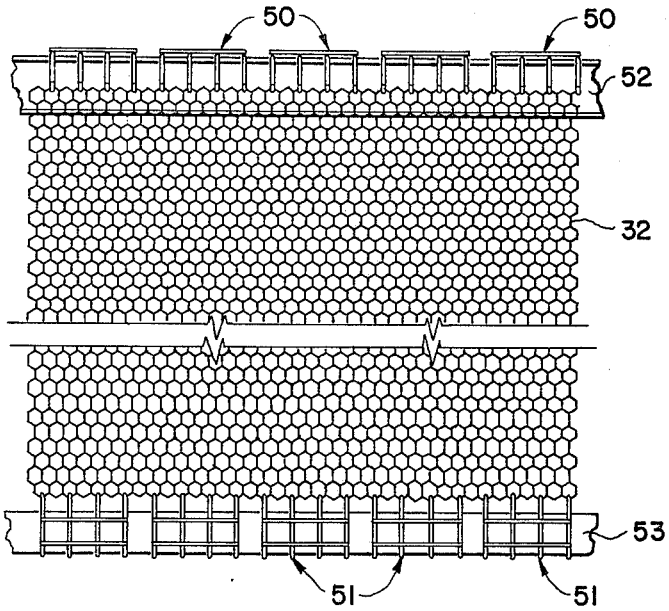
FIG. 12 is a cut away elevation showing the screen frame.
Figure 13:
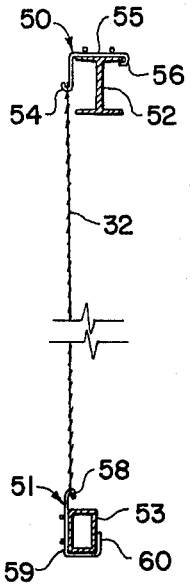
FIG. 13 is a section through the frame.

I have further discovered an improved system for securing the screen to the frame which is superior to the staples described hereinabove or other fastening systems employed heretofore on paddle tennis courts. This system is amenable to all court constructions, including a court assembled on a ground level deck and conventional tensioning devices presently employed. I employ a series of hook like members 50 and 51 to secure the screen 32 to the upper frame member 52 and the lower frame member 53, respectively, FIGS. 12 and 13. The upper frame member 52 is a metal I beam 52 which extends between the uprights (not shown). The lower frame member 53, which is freely suspended in the earlier embodiments, is a metal square tubing 53.

Figure 14:
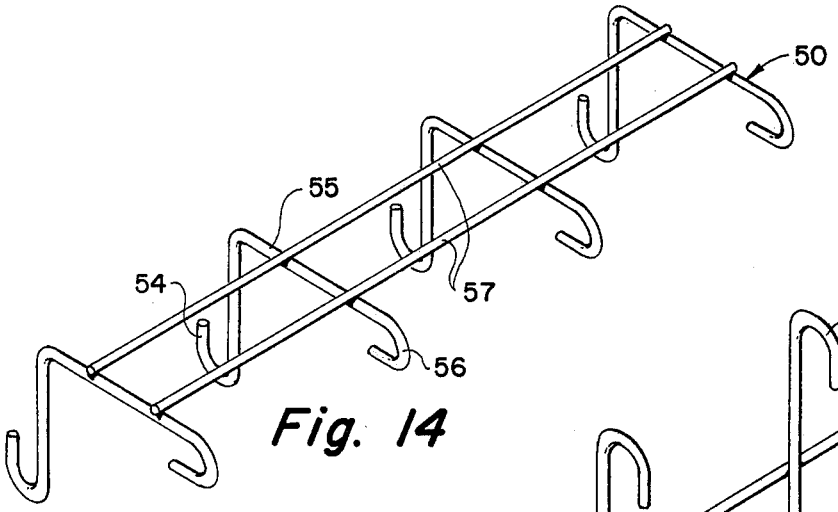
FIG. 14 is an isometric of the upper connecting member.

The upper member 50 comprises a series of double bent hooks adapted to engage both the screen and the frame member, FIG. 14. Specifically, each double bent hook includes a screen engaging hook 54 and a frame engaging hook 56. These hooks are spaced from each other by a spanning section 55 which conforms to the shape of the frame, in this case I beam 52. A series of these double bent hooks are maintained in spaced relationship by two spaced and parallel cross rods 57 onto which the double bent hooks are spot welded to form member 50. Spanning section 55 is constructed so that hook 56 engages the remotely removed flange of the I beam 52, i.e. the flange directed away from the playing court.

Figure 15:
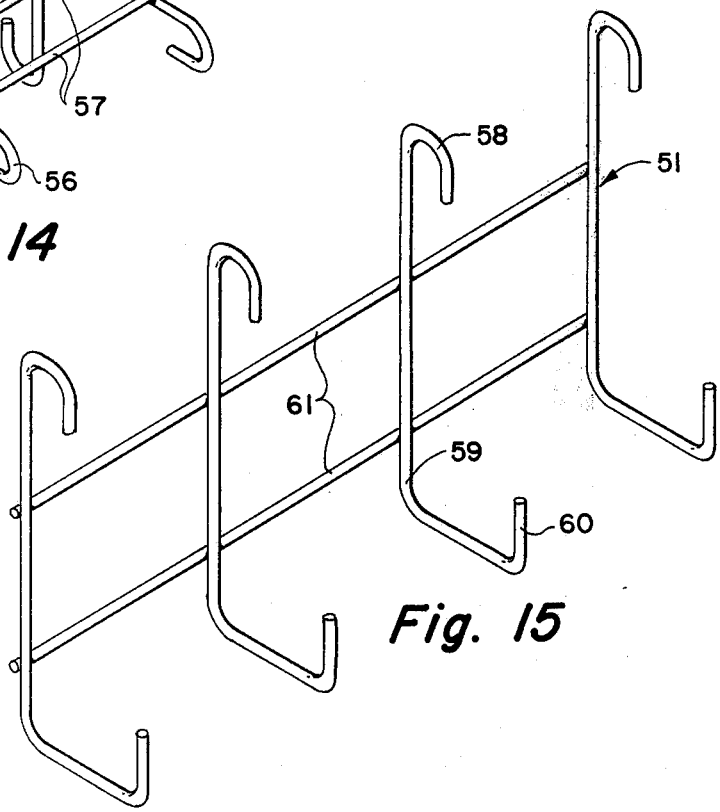
FIG. 15 is an isometric of the lower connecting member.

In a similar manner lower member 51 comprises a plurality of double bent hooks, FIG. 15. Hooks 58 engage the screen and hooks 60 engage the square tubing 53. Hooks 58 and 60 are separated by spanning section 59 which is shaped to extend around two sides of tubing 60 so as to result in hook 60 engaging the remotely removed side of square tubing 60 away from the playing court. A series of double bent hooks are maintained in spaced relationship by two spaced and parallel rods 61 onto which the double bent hooks are spot welded to form member 51. A series of members 50 and 51 are used to secure the screen 32 in place to the frame.

A tension rod 38 is welded to the depending leg of angle 37 in line with the screen 32. The tension rod may also be projected through member 36 in line with the screen and secured in place. The tension rod 38 extends through an aperture in the top flange of channel 19 of the underframe 4, FIGS. 7-9. Tension rod 38 is threaded at its lower end and cooperates with an adjusting nut 39. Tightening of the adjusting nut 39 draws tension rod 38 downward, thereby tightening screen 32. Each framed screen 5 has a plurality of tension rods 38 connected thereto so as to permit individual tensioning of each section of side or end wall. Where the court is placed on a concrete foundation, in-line tensioning is accomplished by sinking an eye bolt in the concrete and connecting it in line with the tension rod through a turnbuckle.

Figure 10:
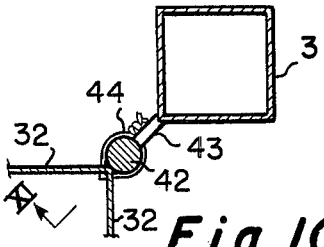
FIG. 10 is a plan view of a corner upright.
Figure 11:
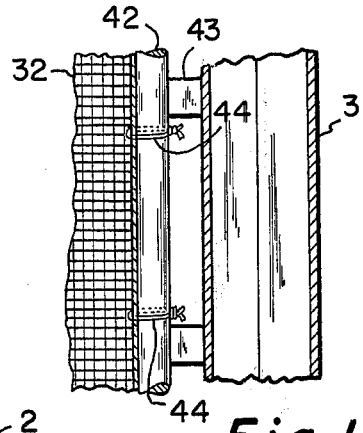
FIG. 11 is a section taken along section lines XI—XI of FIG. 10.

The tensioning of the panels is further improved at the four corners of the court, FIGS. 10 and 11. A round bar 42 spaced from and secured to the square tubing uprights 3 through spacer bars 43. The adjacent panels are secured to the bar 42 by a plurality of strong fabric ties 44 which are free to move up and down the bars 43 as the framed screen panels are tensioned. These corners further improve the play of the game since all corners are true in that they are not directly connected to the uprights as in present day courts and, thus, are not affected by adjustment of either or both adjacent panels in the corner area. In addition, the corners are spaced from all supports so there is no interference at the corners from the supporting structure.

Figure 8:
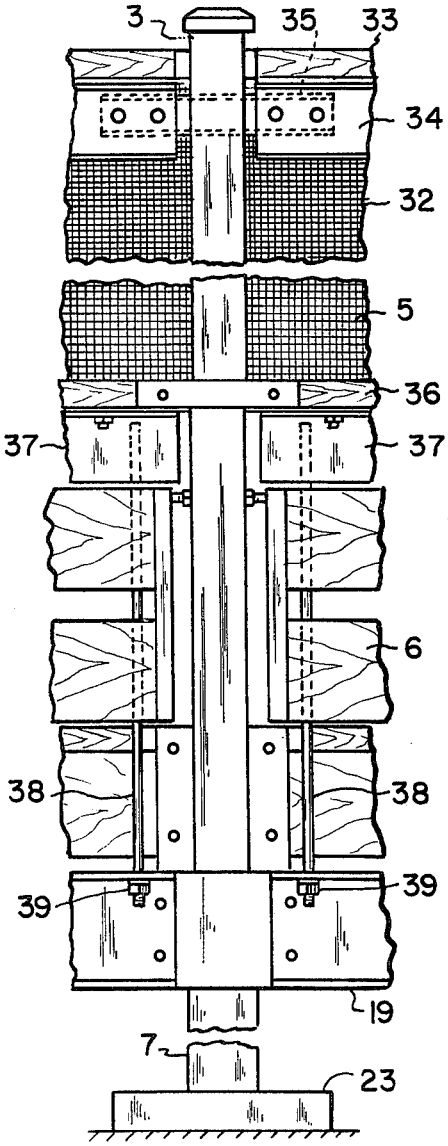
FIG. 8 is an elevation, close up, at an upright.

The snow gates 6 are pivotally connected to the uprights 3 so as to be on the outside of tensioning rods 38 and to be outwardly swingable, FIGS. 8 and 9. The standard door and net and other ancillary equipment are present, are not shown and do not form a part of this invention. Because of the steel connections, all forces are created between steel members. In addition, since tension rod 38 is in line with screen 32, there is no tendency for torsion as per the presently known offset tensioning devices. Further play is improved by the indirect corner connections to the uprights and the unitary action of the deck.

I claim:

1. In a paddle tennis court having a substantially horizontally extending playing surface, substantially vertically extending spaced apart uprights and wire screen panels between said uprights and forming end and side walls of an enclosure around said playing surface, said panels including upper horizontally extending frame members secured to the uprights, lower horizontally extending frame members and wire screen connected therebetween, the improvement comprising a plurality of hook members for securing the wire screen to said upper and lower frame members, each hook member including a plurality of double bent hooks, each double bent hook having a first hook for engaging the wire screen, a second hook for engaging the frame member and a spanning section between said first and second hooks which conforms at least in part in shape to a portion of said frame member engaged thereby, said double bent hooks maintained in spaced apart relationship by at least one support rod connected to and extending normal to said double bent hooks.

* * * * *